United States Patent [19]

Leavens

[11] Patent Number: 4,833,740

[45] Date of Patent: May 30, 1989

[54] INTEGRAL SINK DECK SUPPORT

[75] Inventor: Hudson Leavens, Midland, Canada

[73] Assignee: Waltec, Inc., Midland, Canada

[21] Appl. No.: 96,480

[22] Filed: Sep. 15, 1987

[30] Foreign Application Priority Data

Nov. 3, 1986 [CA] Canada ..... 522033

[51] Int. Cl.[4] ..... E03C 1/33

[52] U.S. Cl. ..... 4/631; 4/619

[58] Field of Search ..... 4/191, 592, 643, 619, 4/631-636, 660, 630, 192; 16/2; 29/34 R, DIG. 3, DIG. 37; 137/359

[56] References Cited

U.S. PATENT DOCUMENTS

| | | | |
|---|---|---|---|
| 973,568 | 10/1910 | Russell | 16/2 X |
| 1,121,146 | 12/1914 | Steel | 4/619 |
| 2,185,186 | 1/1940 | Coordes | 4/619 |
| 2,200,503 | 5/1940 | Judell et al. | 16/2 X |
| 2,884,649 | 5/1959 | Scharmer | 4/631 |
| 3,824,636 | 7/1974 | Brown | 4/619 |

*Primary Examiner*—Henry J. Recla
*Assistant Examiner*—Linda J. Sholl
*Attorney, Agent, or Firm*—Fisher, Christen & Sabol

[57] ABSTRACT

It is known to form one or more faucet mounting holes in the deck portion of a metal sink. To separate the sink deck from the underlying countertop, a gasket is inserted between the sink and countertop in alignment with the holes. This method of construction sometimes results in a skink of inadequate strength to resist bending or warping of the deck around the holes when a faucet is secured on the deck, In addition, such holes often have sharp edges, which may cut through the brass supply tubes of a faucet. The present invention provides an integral deck support around each hole through the sink deck and a method for making the same, in which a deck support is formed by punching a hole in the deck of generally circular shape but such as to leave a plurality of projections extending a predetermined distance toward the center of the hole, extruding the material surrounding said hole downwardly so that the projections extend downwardly from the deck, and rolling said projections back from the hole to form feet spaced around the hole. This results in a sink deck of improved strength and rigidity, without sharp edges around the holes, and that does not require gaskets that may slip or be of improper thickness to separate the sink from the countertop.

4 Claims, 1 Drawing Sheet

INTEGRAL SINK DECK SUPPORT

BACKGROUND OF THE INVENTION

The invention relates to an integral deck support for metal sinks and to a method for manufacturing the same.

Metal sinks, e.g. stainless steel sinks, generally consist of a basin and, as an integral part thereof, a horizontal ledge or rim around the sink, including a back deck portion having at least one faucet mounting hole. When such a sink is installed in a countertop, the rim overlaps the counter and serves to support the sink. Heretofore, a gasket in alignment with each hole has been used to space the deck from the countertop in which it is mounted. At present, the holes are simply cut or punched through the relatively thin metal of the deck.

Several difficulties result from this design. First, there is a tendency for such a deck to bend or collapse, particularly with single hole faucets where stress is concentrated around the hole rather than distributed over a larger area as with a two handle faucet which has a large escutcheon.

Second, the holes punched through such a deck usually have sharp edges, resulting in a danger of severing or damaging the brass supply tubes that protrude through the holes.

Third, a deck constructed of a single layer of material has a tendency to develop waves and depressions or "dishes" resulting in unsightliness and the eventual development of gaps between the deck and the faucet escutcheon.

Fourth, such a sink normally employs a gasket to separate the deck from the counter. Such gasket can slip, resulting in slippage between the sink and the counter. The use of a gasket also can result in improper spacing between the deck and the counter, since such gaskets, washers or rings usually only approximate the correct spacing.

SUMMARY OF THE INVENTION

The present invention solves these problems by replacing the simple punched holes through the deck with integral deck supports, each created by the following procedure: (a) punch a hole in the deck of generally circular shape but such as to leave a plurality of projections extending a predetermined distance toward the center of the hole, (b) extrude the material surrounding the hole downwardly so that the projections extend downwardly from the deck, and (c) roll the projections back from the hole to form feet spaced around the hole.

Thus, in accordance with a broad aspect of the invention, there is provided a deck support for a metal sink having a deck portion with at least one faucet mounting hole, said deck support means surrounding said at least one hole and comprising a plurality of feet extending downwardly and outwardly around said hole, said feet being integral with said deck.

The feet around each hole have portions which are generally parallel to and spaced below the deck portion of the sink. This structure increases the strength and rigidity of the deck, eliminates the sharp edges around the holes and eliminates the need for gaskets or spacers between the deck and the countertop. It also provides solid support for the sink deck when a faucet is mounted on the deck and secured from beneath the countertop.

BRIEF DESCRIPTION OF THE DRAWINGS

The preferred embodiment of the invention will now be described in detail in conjunction with the accompanying drawings in which.

DESCRIPTION OF THE PREFERRED EMBODIMENT

Figure 1:
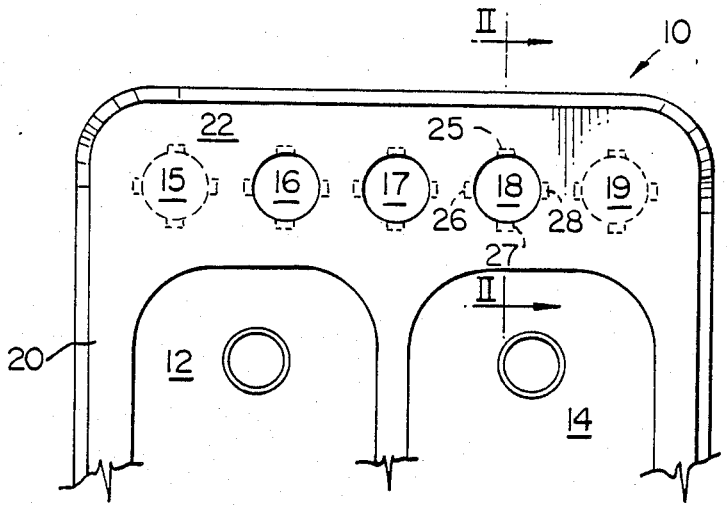
FIG. 1 is a top view of the sink with an integral deck support constructed according to the present invention.

FIG. 1 is a top view of the back portion of a sink 10 having integral deck support means according to the invention. The sink 10 is formed of metal, preferably stainless steel, and is here shown as having two basins 12, 14 and five holes 15–19 for faucet mountings although it is to be understood that the present invention is applicable to sinks having a different number of holes and/or basins, e.g. 1 to 5 holes and 1 to 3 basins. The sink 10 includes a generally horizontal rim 20 including a back deck portion 22 in which the holes 15–19 are formed.

Figure 2:
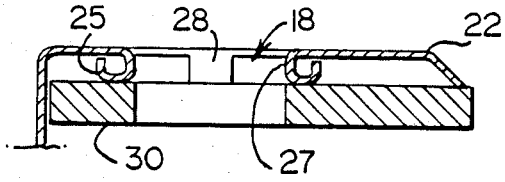
FIG. 2 is a cross-sectional view along the line A-A of FIG. 1.

Turning now to FIG. 2, there is shown a cross-sectional view along the line II—II of FIG. 1 through the deck support surrounding hole 18. The deck support for hole 18 comprises four feet 25, 26, 27 and 28 which are preferably equally spaced apart around the hole 18, only feet 25, 27 and 28 being visible in the cross sectional view of FIG. 2. The procedure for forming each deck support will now be explained in connection with FIGS. 3*a* to 3*f* of the drawings.

Figure 3A:
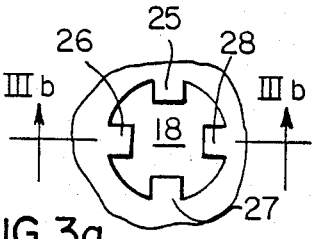
FIGS. 3*a*, 3*c* and 3*e* are top plan views of a hole region of a deck for explaining the procedure for forming the integral deck support according to the invention.
Figure 3B:
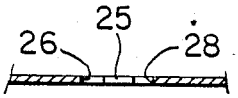
FIGS. 3*b*, 3*d* and 3*f* are elevational views, in cross section, along lines IIIb—IIIb, IIId—IIId and IIIf—IIIf in FIGS. 3*a*, 3*c* and 3*e*, respectively.

The first step of the procedure, FIGS. 3*a* and 3*b*, comprises punching a hole 18 in deck 22 of generally circular shape but such as to leave a plurality of projections 25–28 extending a predetermined distance toward the center of the hole. The exact distance is not critical but has to be sufficient to form the feet in the subsequent steps as will be readily understood. For clarity of understanding the projections have been given the same reference numerals as the feet which they will ultimately form.

Figure 3C:
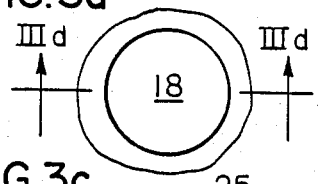
Figure 3D:
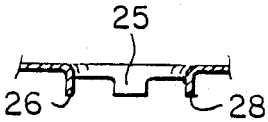

The second step of the procedure, FIGS. 3*c*, 3*d*, comprises extruding the material surrounding the hole, together with the projections, downwardly so that the projections extend downwardly from the deck 22, as best seen in FIG. 3*d*.

Figure 3E:
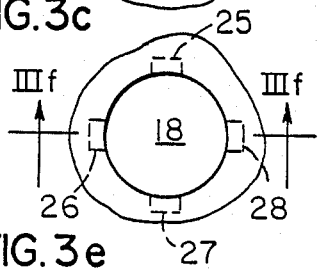
Figure 3F:
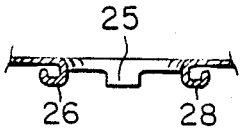

The third step of the procedure, FIGS. 3*e* and 3*f*, comprises rolling the projections back from the hole to form feet spaced apart around the hole. The lower parts of the feet are substantially parallel to the deck 22 of the sink and in this preferred embodiment, approximately ¼" below it. Of course the dimensions may be varied from the examples given if circumstances require.

It can clearly be seen from FIG. 2 that the feet rest on the countertop 30 so that the deck portion 22 is firmly supported above it in the vicinity of the hole 18.

The metal forming operations of punching, extruding, etc. are well known to those skilled in the art and readily accomplished with known metal forming equipment.

From the foregoing it is clear that there has been provided a metal sink with at least one integral deck support, the feet 25–28 being integral with the deck 22.

While four feet are preferred, the number could be varied without departing from the principles of the present invention.

What I claim as my invention is:

1. A metal sink adapted to be supported by a countertop comprising at least one basin and a deck portion integrally connected to said basin and having at least one faucet mounting hole, said deck portion including deck support means surrounding said at least one faucet mounting hole and said deck support means comprising a plurality of feet extending downwardly and outwardly immediately around said at least one faucet mounting hole, said feet being integral with said deck portion and being a support for said deck portion on the countertop whereby the stress on said metal sink at the at least one faucet hole is more effectively distributed thereby preventing the sink from developing depressions and gaps in the area of the at least one faucet hole.

2. A sink as claimed in claim 1 wherein said metal is stainless steel.

3. A sink as claimed in claim 1 including 1 to 5 holes and deck support means.

4. A sink as claimed in claim 2 including 1 to 5 holes and deck support means.

* * * * *